United States Patent [19]

Schmerzler

[11] 4,208,885

[45] Jun. 24, 1980

[54] EXPANDER-COMPRESSOR TRANSDUCER

[76] Inventor: Lawrence J. Schmerzler, 539 Laurel Pl., South Orange, N.J. 07079

[21] Appl. No.: 914,883

[22] Filed: Jun. 12, 1978

Related U.S. Application Data

[63] Continuation of Ser. No. 417,958, Nov. 2, 1973, Pat. No. 4,094,169, which is a continuation-in-part of Ser. No. 59,306, Jul. 29, 1970, abandoned.

[51] Int. Cl.[2] ..... F25D 9/00

[52] U.S. Cl. ..... 62/403; 62/116

[58] Field of Search ..... 62/403, 186, 116; 417/377, 392; 91/234; 137/624, 14

[56] References Cited

U.S. PATENT DOCUMENTS

| | | | |
|---|---|---|---|
| 1,486,486 | 11/1924 | Gates | 91/234 |
| 1,693,863 | 12/1928 | Potter | 62/527 |
| 3,301,471 | 1/1967 | Clarke | 417/392 |
| 3,686,893 | 8/1972 | Edwards | 417/392 |
| 4,094,169 | 6/1978 | Schmerzler | 62/498 |

*Primary Examiner*—William E. Wayner
*Attorney, Agent, or Firm*—Siegmar Silber

[57] ABSTRACT

The expander-compressor transducer of this invention is for expanding refrigerant fluid from a high pressure source into a low pressure heat absorbing heat exchanger while simultaneously precompressing the same fluid stream derived from the low pressure heat absorbing heat exchanger for delivery through suitable conduit heat exchangers to the suction side of the high pressure source.

The device includes a body enclosing a chamber for confinement of refrigerant fluid, a fluid-responsive piston arranged to oscillate in the chamber and dividing the chamber into an expansion chamber at one end and a compression chamber at the other end, a return spring control in the compression chamber for locating the piston into the initial start-up position, a fluid control regulator for permitting flow of the refrigerant fluid into and out of the expansion chamber and into the compression chamber, and a check valve for permitting the refrigerant to flow out of the compression chamber whenever the pressure in the compression chamber overcomes the check valve.

The device effectively provides oscillatory movement of the fluid responsive piston within the chamber, causing concurrently the refrigerant fluid stream to expand in the expansion chamber and to compress in the compression chamber, and producing simultaneously a cooling effect and a work output.

6 Claims, 13 Drawing Figures

FIG. 1
PRIOR ART
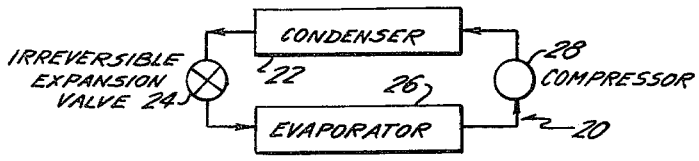
FIG. 2
PRIOR ART
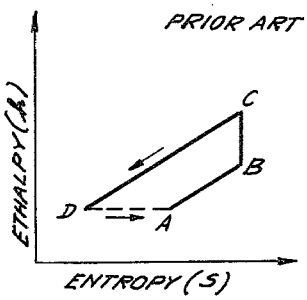
FIG. 3
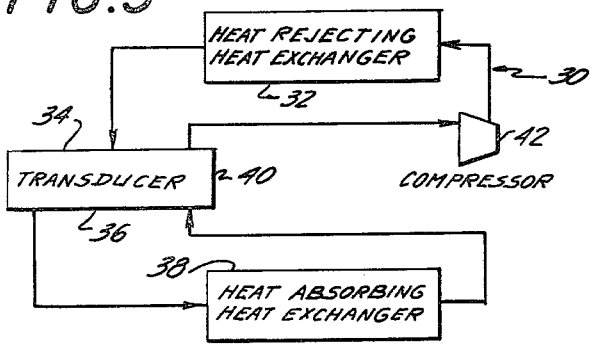
FIG. 4
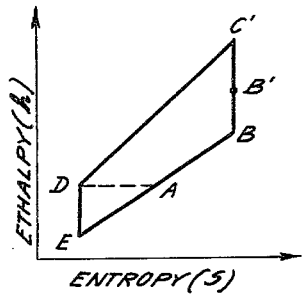
FIG. 6
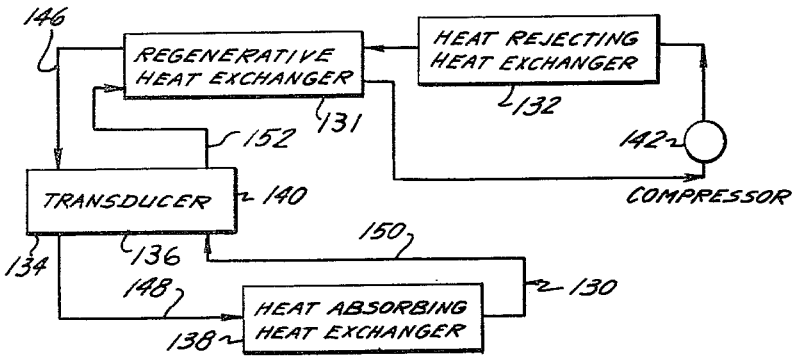
FIG. 7
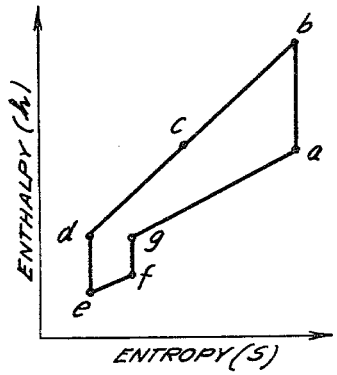
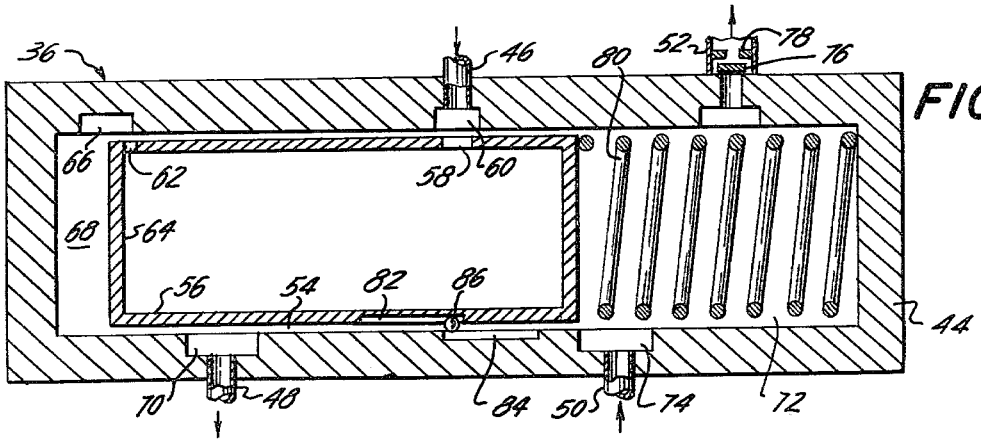
FIG. 5

EXPANDER-COMPRESSOR TRANSDUCER

The application is filed as a continuing application to my prior application, Ser. No. 417,958, filed Nov. 2,1973, and now U.S. Pat. No. 4,094,169, and, which in turn is a continuation-in-part of my original application, Ser. No. 59,306, filed July 29, 1970, now abondoned.

BACKGROUND OF THE INVENTION

1. Field of the Invention

This invention refers generally to an improvement in the refrigeration process and more particularly to a higher efficiency refrigeration process which is enhanced by the inclusion therein of an expander-compressor transducer. In addition to refrigeration, the process is applicable to air conditioning, cryogenic equipment, and heat pumping systems.

2. Description of Prior Art

In the past, the basic components of the well-known refrigeration or vapor compression systems included a compressor, a condenser, a throttling expansion valve, and an evaporator. The compressor is generally driven by some outside motive source such as an electric motor, engine, or turbine and compresses the cold-refrigerant vapor exiting from the evaporator to a high pressure and temperature. This vapor is generally superheated, high-temperature, high-pressure gas and flows into the condenser where such gas is condensed to a compressed liquid state. This liquid then passes through a throttling expansion valve from which the liquid passes from its inflowing high-pressure, compressed-liquid state to a cooled outflowing low pressure, as a very wet vapor, consisting of a mixture of liquid and vapor under saturated conditions of temperature and pressure. This process is variously known as throttling, is enthalpic or irreversible, free expansion, which is wasteful of energy and is characterized by a restriction between the condenser and the evaporator. The restriction is an orifice, a capillary tube, or a valve. The cooled, low-pressure wet mixture flows through the evaporator, where heat is absorbed from the surrounding environment, and in so doing, changes in state from an initially wet mixture to a saturated or slightly superheated vapor on exiting from the evaporator. The cooling effect is brought about by the change in state of the liquid particles to a vapor and is known as heat of vaporization. The cool, low-pressure vapor is drawn into the suction side of the compressor and repeats the cycle. Similar thermodynamic processes employing the above described vapor compression system are used in air conditioning, cryogenic equipment, heat pumps and refrigerators. The conventional systems are in wide use but have performance limitations primarily attributable to the described throttling process. Conventional vapor compression systems degrade rapidly in performance as the temperature differential increases between the low-temperature evaporator and the high-temperature condenser. This temperature differential is inherent in the particular application and reflects the spread between the ambient temperature and operational temperature required by the system. Frequently, as in the case of air conditioners and heat pumps, poor performance is experienced under high-ambient temperatures. In ultra-low-temperature systems, such as cryogenic equipment or low-temperature refrigerators, generally two or more stages of vapor compression refrigeration are utilized to obtain satisfactory operation over a broad temperature spread. In the above described vapor compression cycle, increasing inefficiency is a concomitant of increasing temperature spread. Such a relationship between temperature spread and efficiency is thermodynamically demonstrable even for the most efficient refrigeration or heat pumps known, including the reverse Carnot cycle.

In closely examining the thermodynamic properties of the vapor compression cycle just described, the conclusion was drawn that, while conventional throttling mechanisms are in technological terms simple devices, those devices commonly employed waste energy and restrict the performance of the overall cycle because of thermodynamic irreversibility.

The solution of this problem, not shown in the prior art, would be the replacement of the conventional irreversible expansion process. Additionally, the solution would optimally include utilizing the work obtained from the reversible expansion to precompress partially the refrigerant vapor, thereby resulting in obtaining a greater amount of refrigerating capacity together with reduced net compressor work. Such an improvement would not only yield more efficient performance under standard conditions, but would also extend the useful temperature range of vapor compression cycle beyond the presently realized vapor compression range.

By the way of background, in the prior applications indicated above numerous patents have been provided as references or have otherwise been considered as of interest in preparing this application, and those which bear filing dates prior to the filing of the parent application are the following:

| Patent No. | Inventor |
|---|---|
| 3,613,387 | S.C. Collins |
| 3,591,317 | G.D. James |
| 3,413,815 | E.G.U. Granryd |
| 3,301,471 | M.E. Clarke |
| 3,234,738 | W.L. Cook |
| 2,519,010 | E.W. Zearfoss, Jr. |
| 2,494,120 | B.J. Ferro, Jr. |
| 1,693,863 | T.I. Potter |
| 1,486,486 | P.W. Gates |
| 1,245,603 | W. Lewis |
| 801,612 | W. Schramm |
| 283,925 | J.B. Root |

The prior art devices do not provide the previously detailed efficiency advantages, nor do the patents describing such devices reach toward the present invention in which a unique, thermodynamically regenerative device provides cooling which said device simultaneously provides work output to a piston.

SUMMARY OF THE INVENTION

The invention is a fluid refrigeration process which comprises continuously supplying quantities of a fluid refrigerant in a heat rejecting heat exchanger, expanding the compressed fluid refrigerant in an expansion chamber and concurrently compressing the same fluid stream in a compression shamber after having passed through a heat absorbing heat exchanger, thereby permitting a cooling effect and a work output to occur simultaneously, before returning the fluid refrigerant to the high pressure source for recycling.

With the invention, the fluid from the heat rejecting heat exchanger to the condenser expands in the expansion chamber of the expander-compressor transducer, then flows through the heat absorbing heat exchanger or evaporator, and thence back into the compression chamber of the expander-compressor transducer, thereby acting both before and after it passes through the heat absorbing heat exchanger, and thereafter returning to the compressor to increase the pressure of the fluid to complete the cycle for rejection of the heat at the heat rejecting heat exchanger. In a regenerative cycle configuration, the fluid flows from the heat rejecting heat exchanger through a regenerative heat exchanger before entering the expansion chamber and through the same regenerative heat exchanger after leaving the compression chamber of the expander compressor transducer apparatus, respectively. The invention operates to utilize the output generated during the expansion process to precompress partially the fluid prior to its entering the suction side of the compressor. The invention reduces the net work input to the conventional compressor, increases the useful operating temperature range with an improved Coefficient of Performance, C.O.P. It can be operated with both air or gas and vapor compression refrigeration components.

The invention eliminates the energy wasting prior art throttling valve and replaces it with an expansion-compression transducer consisting of ideally reversible expansion and compression chambers operating as a unit. Prior effects of similar objectives have attempted to utilize rotary or turbine expanders and have failed due to the inherent inefficiency of the relatively small simple turbine. It is well known that small turbines are quite inefficient and that the very low quality, high-velicity wet mixture causes considerable erosion. Typically, the mixture quality in these turbines is limited to a minimum, approximately 88%, corresponding to a wetness of no more than 12% moisture. The quality occuring in a refrigeration turbine is inherently far below that permissible in a reliable turbine. Likewise, development efforts to utilize a rotary expander have failed due to the friction and other thermodynamic losses resulting in a poor efficiency so as to preclude the added complexity and cost.

My invention is a simple efficient reciprocating apparatus having a minimum of parts. It works in conjunction with all components of the conventional refrigeration system with the exception of the conventional expansion control throttling mechanism which it eliminates.

The invention operates in conjunction with conventional refrigerants such as Freon, sulphur dioxide, air, helium, and other fluids and ordinary refrigerant components. The expander-compressor transducer therefore produces an essentially new thermodynamic cycle with a higher C.O.P. and a greater useful temperature range than is presently obtainable from the conventional vapor compression systems.

Other objects and features of the invention will become apparent from the following detailed description of certain embodiments of construction, combination of elements, and arrangement of parts when considered with the accompanying drawings and the scope of the invention will be indicated in the claims.

BRIEF DESCRIPTION OF THE DRAWINGS

FIG. 1 is a schematic diagram of a common prior art refrigeration system which is illustrated having a conventional throttling valve between the condenser and the evaporator;

FIG. 2 is an enthalpy-entropy diagram of the prior art system of FIG. 1;

FIG. 3 is a schematic diagram of a preferred embodiment of my invention in which a refrigeration system is illustrated having a transducer installed across both the condenser/evaporator line and the evaporator/compressor line;

FIG. 4 is an enthalpy-entropy diagram for the preferred embodiment of my invention shown in FIG. 3;

FIG. 5 is a schematic, cross-sectional view of the transducer of the preferred embodiment of FIG. 1;

FIG. 6 is a schematic diagram of another embodiment of my invention in which a regenerator is employed;

FIG. 7 is an enthalpy-entropy diagram for the embodiment of my invention shown in FIG. 6;

DESCRIPTION OF PREFERRED EMBODIMENTS

Figure 8:
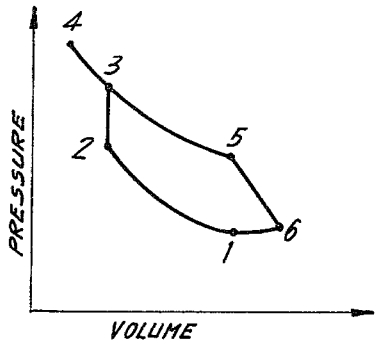
FIG. 8 is a graphical representation of the pressure-volume operational aspect of the expansion chamber of the transducer of the preferred embodiment shown in FIG. 5.

The system of the present invention is best understood in view of a present-day conventional refrigeration system. While the invention is utilizable in applications other than refrigeration cycles, the improved system is described in such a manner for expository purposes. FIGS. 1 and 3 show the schematic diagrams for the prior art refrigeration system and for the system of the present invention, respectively, and FIGS. 2 and 4 show the corresponding enthalpy-entropy diagrams. In the examples discussed below, a halogenated fluorocarbon, specifically dichlorodifluoromethane, is used as the refrigerant.

For comparison of the conventional and the improved systems, the calculations assume the use of dichlordifluoromethane refrigerant in both instances with a nominal condensing saturation temperature and pressure of 120° F. and 172 psia, respectively. Also assumed are (1) no subcooling of the condensed fluid and (2) with saturated vapor leaving the evaporator, a nominal pressure of 0° F. and 24 psia, respectively. The cycles being compared further assume ideal process flow with no frictional fluid pressure losses in the conduits or heat exchangers and no mechanical frictional losses.

In the illustrated prior art ideal thermodynamic vapor system of FIGS. 1 and 2, the system referred to generally as 20, is structured to provide a saturated liquid flow. The system provides for flowing fluid to be irreversibly expanded upon passing from condenser 22 through throttling valve 24. Then to flow to a heat absorbing heat exchanger or evaporator 26 at a constant enthalpy of 36.2 BTU/lb represented by line D-A of the graph of FIG. 2. Thus in conventional systems, the throttling valve is for producing a cold, wet fluid mixture at the stated nominal evaporator temperature and pressure. The system then provides for the wet mixture flow through the evaporator 26 exiting as a saturated vapor having as enthalpy of 78.2 BTU/lb at point C of the graph. The resultant useful refrigeration is 42 BTU/lb. The system provides for the saturated vapor to be compressed by a compressor 28. The compression is ideally isentropic along line B-C of the graph to 172 psia with an enthalpy of 94 BTU/lb. The resultant work required by a compressor 28 is 15.8 BTU/lb. Thus, the structure provides for a coefficient of performance COP of 42/15.8 or 2.7. Upon compression the fluid is then returned to condensor 22, the effect of which is represented by line C-D of the graph of FIG. 2.

In the thermodynamic cycle of the present invention, referred to generally as 30, FIG. 3, starting with the same condensed fluid state as in the previous illustrations. The system of the invention is structured to provide a flow of saturated dichlorodifluoromethane at 172 psia and 120° F. The fluid has enthalpy of 36.2 BTU/lb, and is ideally isentropically expanded along line E-D of FIG. 4, in a first expansion chamber portion 34, FIG. 3, of transducer 36 to the evaporator pressure of 24 psia with an enthalpy of 32.2 BTU/lb. This wet mixture then flows through the evaporator 38, represented by line D-E of FIG. 4, exiting as a saturated vapor as in the prior art example and having as enthalpy of 78.2 BTU/lb.

This saturated vapor then enters a second compression chamber 40, FIG. 3, of transducer 36 using the prior work output of the expanding fluid in the expansion chamber portion 34 to thereby increase the pressure thereof and exit at an enthalpy of 82.2 BTU/lb at point B' of FIG. 4. These actions result in a net work output of zero.

The system then provides for the refrigerant to be compressed isentropically along line B'-C' in a conventional compressor 42, FIG. 3, exiting at the same thermodynamic state, represented by point C', FIG. 4, as the conventional cycle and having an enthalpy of 94 BTU/lb. Upon compression the fluid is then returned to condenser 32, FIG. 3, line C'-D' of FIG. 4. The refrigeration obtained in the evaporator is 46 BTU/lb and the work required in the compressor is 11.8 BTU/lb. The resultant COP is equal to 46/11.8 or 3.9. The COP is thus improved over conventional refrigeration vapor cycles by (3.9−2.7)/2.7 or 45%.

The system provides improvement in performance as shown by the increased amount of refrigeration represented in FIG. 4 by $h_B$–$h_E$ as compared to $h_B$–$h_A$ of FIG. 2. Additionally, as the temperature difference between the evaporator 38 and the condenser 32 increases, the processes represented by lines CD and BAE also differ in slope, and the increased nonparallelism accentuates the improvement of the new cycle over the line AB/line CD parallelism conventional cycle.

In general terms the device of this invention includes an expander-compressor transducer for expanding refrigerant fluid from a high pressure source into a low pressure heat absorbing heat exchanger while simultaneously precompressing the same fluid stream derived from the low pressure heat absorbing heat exchanger for delivery through suitable conduit heat exchangers to the suction side of the high pressure source, comprising a body member enclosing a chamber for confinement of a refrigerant fluid; fluid responsive piston means arranged to oscillate in said chamber and dividing said chamber into an expansion chamber at one end and a compression chamber at the other end; return spring control means in said compression chamber for locating said piston means into initial start-up position; fluid control regulating means for permitting flow of refrigerant fluid into and out of said expansion chamber and into said compression chamber; and, check valve means for permitting refrigerant to flow out of said compression chamber to ambient whenever the pressure in said compression chamber is higher than ambient pressure, thereby effecting oscillatory movement of said fluid responsive piston means within said chamber, causing concurrently the refrigerant fluid stream to expand in said expansion chamber and to compress in said compression chamber, and producing simultaneously a cooling effect and a work output. The device is also usable with a check valve for permitting refrigerant to flow out of said compression chamber is higher than the fluid pressure immediately downstream of said check valve and a regenerative heat exchanger means for precooling inflowing refrigerant fluid into said expansion chamber. This expander-compressor transducer as hereinbefore may also have a regenerative heat exchanger which permits refrigerant to flow out of the low pressure side thereof whenever pressure therein is higher than ambient pressure.

In other words the device is an expander-compressor transducer for expanding refrigerant fluid from a high pressure source into a low pressure heat absorbing hear exchanger while simultaneously precompressing the samd fluid stream derived from the low pressure heat absorbing heat exchanger for delivery through suitable conduit heat exchangers to the suction side of the high pressure source, comprising an expansible chamber; fluid responsive piston means arranged to oscillate in said chamber and divide said chamber into an expansion chamber and a compression chamber; return spring control means in said compression chamber for locating said piston into initial start-up position; fluid passage control means for supplying refrigerant fluid into said expansion chamber; check valve means for permitting refrigerant flow out of said compression chamber whenever the pressure in said compression chamber is higher than ambient pressure; and fluid output and fluid input means for controlling the flow of refrigerant fluid to and from said expansion chamber and for controlling the flow of refrigerant fluid to said compression chamber.

The device is also usable with a check valve for permitting refrigerant flow out of said compression chamber whenever the pressure in said compression chamber is higher than the fluid pressure immediately downstream of said check valve, and a regenerative heat exchange means for precooling inflowing refrigerant fluid into said expansion chamber.

Referring now to FIG. 5 showing the preferred form of the embodiment of the compressor-expander apparatus (CEXA) or transducer 36. The transducer comprises the outer shell or structural housing 44 which is provided with connections for evaporator, compressor, and condenser as described schematically in FIG. 3. High pressure inlet conduit 46 is structured for directing the fluid to the CEXA from condenser 32; expansion fluid outlet conduit 48, for directing the fluid to the evaporator 38; and low pressure inlet conduit 50, for receiving the fluid from the evaporator 38; and low pressure fluid outlet conduit 52, for returning the fluid to the suction side of the compressor.

Within the structural housing 44 is a fluid chamber 54 and a piston 56 which oscillates by action of two communicating fluids therein. Piston 56 is a closed container with piston fluid inlet passage 58 located on the wall thereof in a manner so as to permit high pressure fluid from condenser 32 access to passage 58 when aligned with high pressure inlet port 60 on the wall of the action chamber 54 through the high pressure inlet conduit 46.

The structure provides for the fluid path to continue through piston fluid outlet passage 62 on the wall of the piston 56 to pass the passage chamber 66 to compress momemtarily in the expansion chamber 68. Piston fluid outlet passage 62 is located on piston 56 so that alignment with the expansion chamber outlet port 70 will not occur. To maintain a fluid tight connection during oscillation and to prevent leakage, tolerances between piston 56 and fluid action chamber 54 are very close.

Also within structural housing 44 and forming another portion of fluid action chamber 54 is the compression chamber 72 which is provided for correspondingly opposite action of expansion chamber 68. The structure provides for fluid acted upon in a compression chamber 72 to be directed thereinto by conduit 46 through low pressure inlet port 74 and to be directed therefrom, after passing through fluid outlet check valve 76 by conduit 52. The check valve 76 is retained between the exterior wall of housing 44 and conduit 52 by retainer 78. The piston 56 is effectively provided with return energy by coil spring 80 which, upon sufficient fluid flowing through passage 66 and into expansion chamber 68 and upon consequent movement of piston 56 decreasing the size of compression chamber 72, is provided to restore piston 56 to its original position in an oscillatory manner. Although shown as a coil spring in this embodiment, the return means may be any of a number of energy storing devices known in the art.

Alignment means of the piston 56 is provided by the action of piston alignment groove 82 and structural housing alignment groove 84 and alignment ball-bearing 86. Spring 80 automatically locates piston 56 in the starting position.

In cyclic operation, piston 56 moves within fluid action chamber 54 in oscillating action. As the piston 56 moves to the right as shown in the diagram and outlet piston passage 62 is shut by the wall of the fluid action chamber 54 and the piston inlet passage 58 is similarly closed. The pressure and temperature of the refrigerant contained in the expansion chamber 68 reducing its temperature and pressure until the expansion chamber outlet port 70 is uncovered by piston 56 allowing refrigerant to flow through expansion chamber outlet conduit 48 to the evaporator 38. The motion of the piston 56 is limited by the combined action of the spring 80 and the action of the compressed fluid in the compression chamber 72. After the motion to the right is terminated, the piston 56 is returned to its original position on the left portion of the fluid action chamber 54 by the action of the energy stored in the spring 80 and the compression in the compression chamber 72.

Again, as the piston 56 moves to the right, the low pressure inlet port 74 in the compression chamber 72 is covered and the vapor pressure therein increases and causes the compressed vapor outlet check valve 76 to open, allowing the compressed fluid to flow through the compressed fluid outlet conduit 52. The check valve 76 is controlled by the compressed vapor outlet check valve retainer 78.

The energy stored in the compressed fluid compression chamber 72 eventually stops and reverses the motion of the piston 56. In cyclic operation, as piston 56 moves from the right hand position to the left, the compressed fluid outlet check valve 76 closes and the pressure of the fluid in compression chamber 72 reduces. As piston 56 continues its movement to the left, low pressure fluid flows into compression chamber 72 through low pressure inlet conduit 50 through low pressure inlet port 74.

As piston 56 moves from right to left further, high pressure fluid again flows from the exterior source into piston 56 through inlet passage 58 to maintain the high pressure in the interior of piston 56. The continued motion of the piston 56 to the left into the expansion chamber 68 causes the fluid therein to be compressed. At the left position of the piston 56 in the expansion chamber 68, high pressure fluid is partially released when piston outlet passage 62 communicates with passage chamber 66 allowing a portion of the compressed fluid to flow into the expansion chamber 68, thereby causing piston 56 eventually to stop and to reverse its direction of motion towards the low pressure chamber 72.

The transducing action of the expander-compressor transducer occurs upon the energy stored in the high pressure refrigerant liquid being transferred into kinetic energy of the piston and upon the energy stored in the spring and the low pressure refrigerant vapor being also transferred into kinetic energy of the piston. Using the work from both ends of the oscillatory piston movement is a characteristic feature of the transducing energy relationship of this invention.

The expander-compressor transducer cycle operates through the introduction of a high pressure fluid from the condenser source, through passage 58 of the piston 56 to a varying volume in the fluid action chamber 54, a high pressure in the expansion chamber 68, and a low pressure in compression chamber 72, respectively. The fluid expands in the expansion chamber 68, driving the piston 56 into an oscillatory motion, permitting the fluid to flow by the self-regulating fluid actuated control from expansion chamber 68 through the evaporator 38 to a low pressure region in compression chamber 72. The fluid absorbs heat in the process. The fluid is further compressed in compression chamber 72, raising the pressure slightly above the level of the inlet pressure of the exterior conventional compressor 42 in the case of a closed refrigeration system. The expander-compressor transducer is adjusted to result in oscillatory motion to produce expansion work equivalent to compression work with allowance for friction and other losses. It will, of course, be understood that the low pressure fluid exiting from the compression chamber 72 will return to the exterior inlet side of the compressor.

Referring now to FIG. 6, there is a flow diagram showing another embodiment in which the expander-compressor transducer of this invention is combined with a regenerator. It is similar to FIG. 1 except that a conventional counterflow thermal regenerator is interposed in the flow path between the transducer high pressure inlet conduit 146 and low pressure fluid outlet conduit 152 and the compressor 142 and heat rejecting heat exchanger 132. In the second embodiment items in FIG. 6 that are similar to corresponding ones in FIG. 3 will be given for sake of clarity reference designators "100" digits above those in FIG. 3. Thus, the compressor 142, FIG. 6, corresponds to compressor 42, FIG. 3.

The second embodiment referred to generally as 130, FIG. 6, is structured to provide a rejection heat exchange 132 which provides fluid at high pressure through regenerator 131 and high pressure inlet conduit 146 to the expansion chamber portion 134 of expander-compressor transducer 136. After being operated upon by the transducer, the structure provides for fluid flow through conduit 148 to absorbing heat exchanger 138 and thence through conduit 150 to the compression chamber portion 140. The transducer here again operates upon the fluid presented thereat and the structure further provides for fluid flow through conduit 152 to regenerator 131, thence to compressor 142 and completing the cycle to rejection heat exchanger 132. The second embodiment enhances the low temperature or cryogenic performance of the process when using a gaseous rather than a liquid/vapor refrigerant.

the enthalpy-entropy diagram, FIG. 7, for the embodiment with the regenerator for obtaining cryogenic temperatures shows the closed-loop of a-b-c-d-e-f-g-a. At a the fluid enters the compressor; at b, leaves the compressor; at c, enters the regenerator; at d, leaves the regenerator which corresponds to the gaseous state at high pressure inlet conduit 146. Point e corresponds with the state at expansion fluid outlet conduit 148. Point f corresponds with the gaseous state at low pressure inlet conduit 150. Point g corresponds with the gaseous state of the fluid outlet conduit 152. Processes c-d and g-a occur simultaneously in a conventional manner in the regenerative heat exchanger.

The pressure-volume relationship for the expander occuring in the expansion chamber portion 34 of FIG. 3 is shown in FIG. 8. Starting at the state point expanding the refrigerant fluid to state point 5 where the expansion chamber outlet conduit 148 is uncovered and the pressure drops down to the evaporator pressure at point 6. The piston 56 then reverses direction because of the previously described transducing action and maintains the evaporator pressure from state point 6 to state point 1 where the expansion chamber outlet conduit 148 is covered and the pressure increases until outlet piston passage 62 and passage chamber 66 communicate allowing the high pressure fluid contained within the piston 56 to flow into expansion chamber 68 thereby increasing the pressure from state point 2 to state point 3 at which point the outlet piston passage 62 is closed by the left edge of the piston head plate 64. The vapor contained in the expansion chamber 68 is compressed by the inertial effects of the piston 56 thereby causing the piston 56 to reverse in direction and to replicate the cycle. The closed cycle 1-2-3-4-5-6-1 is a new and novel refrigeration cycle which uniquely combines the characteristic forms of both the Otto and Brayton thermodynamic engine cycles and a free-piston engine.

Figure 9:
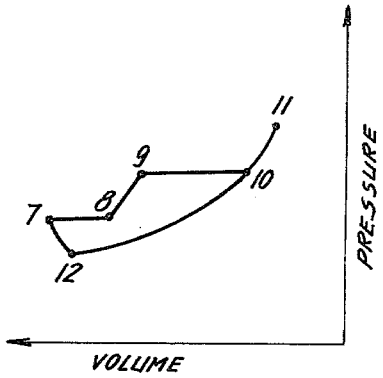
FIG. 9 is a graphical representation of the pressure-volume operational aspect of the expansion chamber of the transducer of the preferred embodiment shown in FIG. 5.

The pressure-volume relationship occuring in the compression chamber portion 40 of FIG. 3 is detailed in FIG. 9. Starting at state point 7, with piston 56 of FIG. 3 at the extreme left side of the expander-compressor transducer, the evaporator pressure nominally exists from state point 7 to state point 8 at which point the low pressure inlet port 74 is covered. The vapor pressure is increased until its pressure is nominally equal to the suction pressure at the inlet to the refrigeration compressor. The pressure remains constant from state point 9 to state point 10 until the opening to outlet check valve 76 is covered by the leading edge of the piston and the pressure is increased to state point 11. The high pressure and energy transducing action causes the piston 56 to reverse and results in an ideally isentropic expansion to a pressure lower than the evaporator pressure at state point 12 where the low pressure inlet port 74 is uncovered by the right hand edge of the piston 56. The refrigerant vapor form the evaporator flows into the compression chamber 72 increasing the pressure therein up to the evaporator pressure at state point 7. The cycle 7-8-9-10-11-12-7 is repeated.

The energy output of the expansion chamber 68 cycle 1-2-3-4-5-6-1 is equal to the energy input of the compression chamber 72 cycle 7-8-9-10-11-12-7 plus the losses. The representations shown consist of quasi-idealized processes.

Figure 10:
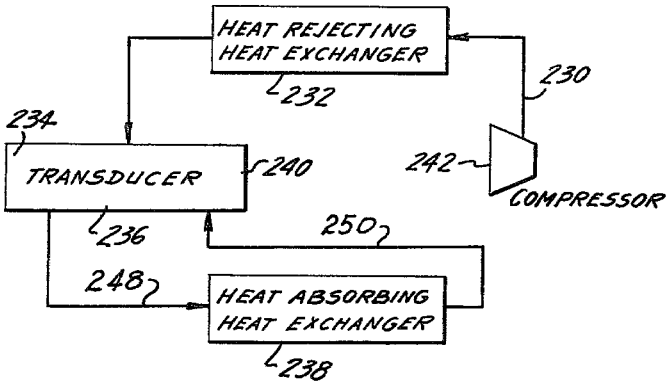
FIG. 10 is a schematic diagram of another embodiment of my invention which shows the embodiment of FIG. 3 in an opencycle mode.
Figure 11:
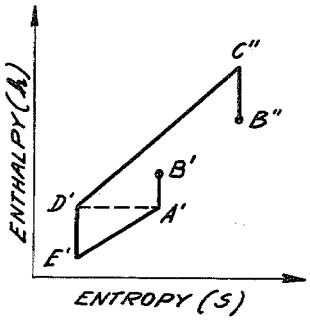
FIG. 11 is an enthalpy-entropy diagram for the embodiment of my invention shown in FIG. 10.
Figure 12:
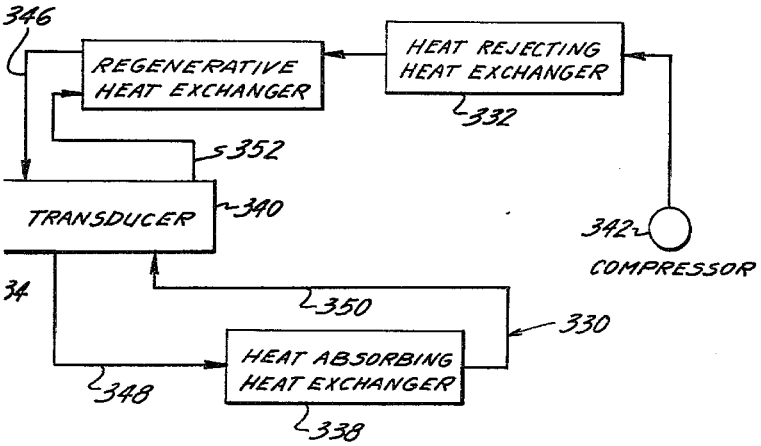
FIG. 12 is a schematic diagram of yet another embodiment of my invention which shows the transducer with regenerative heat exchanger of FIG. 6 in an opencycle mode.

Referring now to FIGS. 10 through 13, open-cycle analogs of FIGS. 3, 4, 6, and 7 are shown. Comparing FIGS. 10 and 3, the cycle of FIG. 10 is open by eliminating the conduit between the transducer and the compressor. Similarly, comparing FIGS. 12 and 6, the cycle of FIG. 12 is open by eliminating the conduit between the regenerator and the compressor.

The system illustrated in FIG. 10 is the open-cycle embodiment in which the expander-compressor transducer of the invention is utilized. In this embodiment, items in FIG. 10 that are similar to corresponding ones in FIG. 3 will be given for sake of clarity reference designators "200" digits above those in FIG. 3. Thus, the compressor 242, FIG. 10, corresponds to compressor 42, FIG. 3. The embodiment referred to generally as 230, FIG. 10, is structured to provide a rejection heat exchange 232 which provides fluid at high pressure through and high pressure inlet conduit 236 to the expansion chamber portion 234 of expander-compressor transducer 246. After being operated upon by the transducer, the structure provides for fluid flow through conduit 248 to absorbing heat exchanger 238 and thence through conduit 250 to the compression chamber portion 240. The transducer here again operates upon the fluid presented thereat and the structure further provides for fluid flow through the check valve of the transducer to the atmosphere. A compressor 242 provides input to rejection heat exchanger 232.

FIG. 11 provides the enthalpy-entropy diagram for the open-cycle embodiment just described. Fluid enters the open-cycle at the open inlet port of compressor 242 and is isentropically compressed thereby, graphically represented by line B'-C" C". Whereupon, fluid enters the heat rejecting heat exchanger 232 and is cooled along line C"-D'. The cooled fluid then enters transducer 236 and flows through ports 60 and openings 58 and 62 into expansion chamber 68 and is isentropically expanded. This expansion shown as D'-E' precedes the heat absorbing heat exchanger 238 stage and passes through the compression chamber portion 340 to the atmosphere, represented as point B' of FIG. 11.

More particularly, FIG. 12 provides a schematic diagram showing another embodiment in which the expander-compressor transducer of this invention is combined with a regenerator. In this embodiment, items in FIG. 12 that are similar to corresponding ones in FIG. 6 will be given for the sake of clarity reference designators "300" digits above those in FIG. 6. Thus, the compressor 342, FIG. 12, corresponds to compressor 142, FIG. 6. This open-cycle embodiment referred to generally as 330, FIG. 12, is structured to provide a rejection heat exchanger 332 which provides fluid at high pressure through regenerator 331 and high pressure inlet conduit 346 to the expansion chamber portion 334 of expander-compressor transducer 336. After being operated upon by the transducer, the structure provides for fluid flow through conduit 348 to absorbing heat exchanger 338 and thence through conduit 350 to the compression chamber portion 340. The transducer here again operates upon the fluid presented thereat and the structure further provides for fluid flow through conduit 352 to regenerator 331, the corresponding outlet of which is open to the atmosphere. A compressor 342 provides input to the rejection heat exchanger 332.

Figure 13:
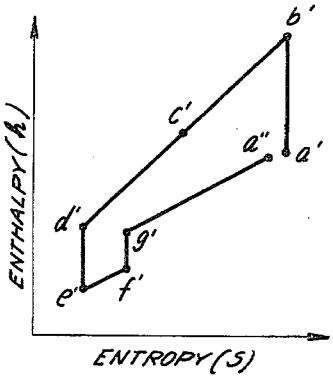
FIG. 13 is an enthalpy-entropy diagram for the embodiment of my invention shown in FIG. 12.

The enthalpy-entropy diagram, FIG. 13, for the open-cycle embodiment with the regenerator for obtaining cryogenic temperatures shows the open curve of a'-b'-c'-d'-e'-f'-g'-a''. From open point a', the fluid enters the compressor; at b', the fluid leaves the compressor; at c', enters the regenerator; at d', leaves the regenerator which corresponds to the gaseous state at high pressure inlet conduit 346. Point e' corresponds with the state at expansion fluid outlet conduit 348. Point f' corresponds with the gaseous state at low pressure inlet conduit 350. Point g' corresponds with the gaseous state of the fluid outlet conduit 352. Processes c'-d' and g'-a'' occur simultaneously in a conventional manner in the regenerative heat exchanger 246.

What is claimed is:

1. An expander-compressor transducer for expanding refrigerant fluid from a high pressure source into a low pressure heat absorbing heat exchanger while simultaneously precompressing the same fluid stream derived from the low pressure heat absorbing heat exchanger for delivery through suitable conduit heat exchangers to the suction side of the high pressure source, comprising a body member enclosing a chamber for confinement of a refrigerant fluid, fluid responsive piston means arranged to oscillate in said chamber and dividing said chamber into an expansion chamber at one end and a compression chamber at the other end, return spring control means in said compression chamber for locating said piston means into initial start-up position, fluid control regulating means for permitting flow of refrigerant fluid into and out of said expansion chamber and into said compression chamber, and check valve means for permitting refrigerant to flow out of said compression chamber to ambient whenever the pressure in said compression chamber is higher than ambient pressure, thereby effecting oscillatory movement of said fluid responsive piston means within said chamber, causing concurrently the refrigerant fluid stream to expand in said expansion chamber and to compress in said compression chamber, and producing simultaneously a cooling effect and a work output.

2. An expander-compressor transducer for expanding refrigerant fluid from a high pressure source into a low pressure heat absorbing heat exchanger while simultaneously precompressing the same fluid stream derived from the low pressure heat absorbing heat exchanger for delivery through suitable conduit heat exchangers to the suction side of the high pressure source, comprising a body member enclosing a chamber for confinement of a refrigerant fluid, fluid responsive piston means arranged to oscillate in said chamber and dividing said chamber into an expansion chamber at one end and a compression chamber at the other end, return spring control means in said compression chamber for locating said piston means into initial start-up position, fluid control regulating means for permitting flow of refrigerant fluid into and out of said expansion chamber and into said compression chamber, check valve means for permitting refrigerant to flow out of said compression chamber whenever the pressure in said compression chamber is higher than the fluid pressure immediately downstream of said check valve means, regenerative heat exchanger means for precooling inflowing refrigerant fluid into said expansion chamber, thereby effecting oscillatory movement of said fluid responsive piston means within said chamber, causing concurrently the refrigerant fluid stream to expand in said expansion chamber and to compress in said compression chamber, and producing simultaneously a cooling effect and a work output.

3. An expander-compressor transducer as described in claim 2 wherein said regenerative heat exchanger means permits refrigerant to flow out of the low pressure side thereof whenever pressure therein is higher than ambient pressure.

4. An expander-compressor transducer for expanding refrigerant fluid from a high pressure source into a low pressure heat absorbing heat exchanger while simultaneously precompressing the same fluid stream derived from the low pressure heat absorbing heat exchanger for delivery through suitable conduit heat exchangers to the suction side of the high pressure source, comprising An expansible chamber fluid responsive piston means arranged to oscillate in said chamber and divide said chamber into an expansion chamber and a compression chamber, return spring control means in said compression chamber for locating said piston into initial start-up position, fluid passage control means for supplying refrigerant fluid into said expansion chamber, check valve means for permitting refrigerant flow out of said compression chamber whenever the pressure in said compression chamber is higher than ambient pressure, fluid output and fluid input means for controlling the flow of refrigerant fluid to and from said expansion chamber and for controlling the flow of refrigerant fluid to said compression chamber.

5. An expander-compressor transducer for expanding refrigerant fluid from a high pressure source into a low pressure heat absorbing heat exchanger while simultaneously precompressing the same fluid stream derived from the low pressure heat absorbing heat exchanger for delivery through suitable conduit heat exchangers to the suction side of the high pressure source, comprising an expansible chamber fluid responsive piston means arranged to oscillate in said chamber and divide said chamber into an expansion chamber and a compression chamber, return spring control means in said compression chamber for locating said piston into initial start-up position, fluid passage control means for supplying refrigerant fluid into said expansion chamber, check valve means for permitting refrigerant flow out of said compression chamber whenever the pressure in said compression chamber is higher than the fluid pressure immediately downstream of said check valve means regenerative heat exchange means for precooling inflowing refrigerant fluid into said expansion chamber.

6. An expander-compressor transducer as described in 5 wherein said regenerative heat exchanger means permits refrigerant to flow out of the low pressure side thereof whenever pressure therein is higher than ambient pressure.

* * * * *